US007418907B2

(12) United States Patent
Haimoff

(10) Patent No.: US 7,418,907 B2
(45) Date of Patent: Sep. 2, 2008

(54) MULTI-SHELF COLLAPSIBLE TABLE

(75) Inventor: Efraim Haimoff, Mevasereth Zion (IL)

(73) Assignee: Keter Plastic Ltd., Herzelyia (IL)

( * ) Notice: Subject to any disclaimer, the term of this patent is extended or adjusted under 35 U.S.C. 154(b) by 342 days.

(21) Appl. No.: 11/126,217

(22) Filed: May 11, 2005

(65) Prior Publication Data

US 2006/0254480 A1 Nov. 16, 2006

(51) Int. Cl.
*A47B 7/00* (2006.01)
*A47B 3/00* (2006.01)

(52) U.S. Cl. ..... 108/91; 108/115; 108/132

(58) Field of Classification Search ..... 108/91, 108/162, 163, 164, 166, 176, 173, 174, 175, 108/179, 115, 116, 117, 125, 126, 127–132, 108/59; 248/150; 269/139, 901, 99, 16, 269/6; 144/306–308
See application file for complete search history.

(56) References Cited

U.S. PATENT DOCUMENTS

| | | | | | |
|---|---|---|---|---|---|
| 1,026,475 | A * | 5/1912 | Tarbuck | 269/100 |
| 2,831,583 | A * | 4/1958 | Wright et al. | 108/173 |
| 2,978,114 | A * | 4/1961 | Halligan | 108/173 |
| 3,146,736 | A * | 9/1964 | Hetrick | 108/176 |
| 3,661,100 | A * | 5/1972 | Tennant | 108/132 |
| 4,102,555 | A * | 7/1978 | Tobolski | 312/240 |
| 4,148,264 | A | 4/1979 | Caravias | |
| 4,154,435 | A * | 5/1979 | Alessio | 269/139 |
| 4,170,345 | A * | 10/1979 | Townsend | 269/88 |
| 4,555,099 | A * | 11/1985 | Hilton | 269/88 |
| 4,706,817 | A * | 11/1987 | Greathouse | 206/545 |
| 5,005,449 | A * | 4/1991 | Sorensen et al. | 81/152 |
| 5,009,134 | A * | 4/1991 | Sorensen et al. | 81/487 |
| 6,053,116 | A | 4/2000 | Jung et al. | |
| 6,113,088 | A * | 9/2000 | Gakhar et al. | 269/139 |
| 6,286,824 | B1 * | 9/2001 | Sagol | 269/99 |
| 6,412,158 | B1 * | 7/2002 | Moore | 29/249 |
| 6,659,440 | B2 * | 12/2003 | Levy | 269/45 |
| 6,763,770 | B2 | 7/2004 | Marrujo | |
| 6,997,111 | B2 * | 2/2006 | Giegerich | 108/25 |
| 2005/0115476 | A1 * | 6/2005 | Savoie | 108/115 |
| 2005/0217541 | A1 * | 10/2005 | Shepherd | 108/115 |

* cited by examiner

*Primary Examiner*—Janet M. Wilkens
*Assistant Examiner*—Timothy M Ayres
(74) *Attorney, Agent, or Firm*—Nath Law Group; Jerald L. Meyer; Derek Richmond

(57) ABSTRACT

A folding table comprises an upper panel, a lower panel, and a plurality of legs swingably articulated to the upper panel. The table is collapsible between an open position, in which the panels are separated, and a closed position, in which the panels are adjacent. Displacement of the lower panel into the open position entails deployment of the legs into a substantially upright position supporting the table in its open position.

24 Claims, 15 Drawing Sheets

MULTI-SHELF COLLAPSIBLE TABLE

FIELD OF THE INVENTION

This invention relates to folding tables, and in particular to those having two working surfaces at different heights.

BACKGROUND OF THE INVENTION

Collapsible tables are ubiquitous contrivances used for a host of applications. The most common comprise a single working surface, and legs which collapse for easy storage of the table. Less common are collapsing tables having more that one working surface. These tables typically comprise, in their respective open positions, two surfaces, one below the other.

U.S. Pat. No. 6,053,116 discloses a foldable table having an upper support plate, first and second side support plates extending downward from the upper support plate to contact with a floor, an upper pivot plate downwardly pivotable and hinged to the upper support plate. The first and second side pivot plates are inwardly pivotable and are hinged to the first and second side support plates. The first and second wing plates are formed at the first and second side pivot plates and are upwardly pivotable therefrom. The table is fully folded in a compact configuration when the first and second side pivot plates are pivoted inwardly and the upper pivot plate is pivoted downwardly.

U.S. Pat. No. 6,763,770 discloses a folding portable table including an upper table surface, a number of folding table legs, and a lower table surface. The lower table surface is held between the legs by pins protruding from the perimeter of the lower table surface and is slideably retained in grooves therein. The pins slide up and down within the grooves, allowing the lower table surface to be raised up to, or lowered down from, the upper table surface. When the lower table surface is raised up adjacent to the upper table surface, the legs can be folded under the upper table surface for transport and storage of the table. The table can be deployed by unfolding the legs and lowering the lower table surface down from the upper table surface. The grooves may be tapered from top to bottom such that the pins are frictionally bound in the deployed position in order to make the table stronger.

SUMMARY OF THE INVENTION

According to one aspect of the present invention, there is provided a folding table comprising an upper panel, a lower panel, and a plurality of legs swingably articulated to the upper panel. The table is collapsible between an open position, in which the panels are separated, and a closed position, in which the panels are adjacent. Displacement of the lower panel into the open position entails deployment of the legs into a substantially upright position supporting the table in its open position.

According to another aspect of the present invention, there is provided a folding table which is collapsible between an open and a closed position. The table comprises an upper panel, a lower panel, and a plurality of legs. Each leg is shiftable between an upright position and stowed position. When the table is in the open position, the panels are separated from one another and the legs are in the upright position, and when the table is in the closed position, the panels are adjacent one another and the legs are in the stowed position.

When the table is in the open position, the panels are parallely separated from one another, and when in the closed position, the panels may be in full contact with one another.

The table, according to one of the embodiments, comprises at least two supports which attach the panels. The supports are each shiftable between a collapsed position, associated with the table in the closed position, and an erect position, associated with the table in the open position. According to one particular embodiment, the supports extend between corresponding edges of the panels, and each comprises an upper portion and a lower portion hingedly articulated to each other.

According to a modification of the present invention, when converting the table to the open position, the bottom panel is displaced away from the top panel by gravity, thereby entailing shifting of the legs to their upright position and the supports to their erect position. The lower panel comprises elongate opening sized and located to allowing swinging therethrough of the legs. This arrangement permits the legs to shift from their stowed position to their upright position upon opening of the table.

The top of each leg and the lower panel optionally comprises cooperating arrangements adapted to shift the legs from their upright positions to their stowed positions upon collapse of the table from the open to the closed position. The arrangement, according to one embodiment, is a cam and follower arrangement, wherein the cam is in the form of an inclined plane projecting from the top surface of the lower panel, and the follower is in the form of hooked member projecting from the top of each leg. The hooked member preferably is rounded to facilitate smooth sliding thereof on the inclined plane.

The table has, according to a further modification of the present invention, a first latching arrangement adapted to secure it in the closed position, and a second latching arrangement, associated with the supports, adapted to secure the table in the open position.

According to a further embodiment of the present invention, the table is adapted to store at least one vise in at least one of the panels. The vise, according to one modification, is fully received within the panel. The vise comprises a fixed jaw section and a movable jaw section connected thereto by a rail and adjustable along the length of the rail.

According to a further modification, the upper panel comprises a least one groove, in a top surface thereof, adapted to receive the rail of the vise. The upper panel also comprises at least one through-passing aperture, having reinforced sides, of sufficient size to allow passage therethrough of the rail. Additionally, the upper panel is reinforced at side-margin areas.

The table according to the present invention is adapted for use with the vise wherein the rail is passed through the through-passing aperture, allowing the fixed jaw portion to abut a top surface of the upper panel and the movable jaw portion to abut the bottom surface of the upper panel. Additionally, a chuck is provided which is receivable within the aperture and adapted, when thus received, to cooperate for clamping with the vise in a lying position.

BRIEF DESCRIPTION OF THE DRAWINGS

In order to understand the invention and to see how it may be carried out in practice, several embodiments will now be described, by way of non-limiting example only, with reference to the accompanying drawings, in which.

DETAILED DESCRIPTION OF EXEMPLARY EMBODIMENTS

Figure 1:
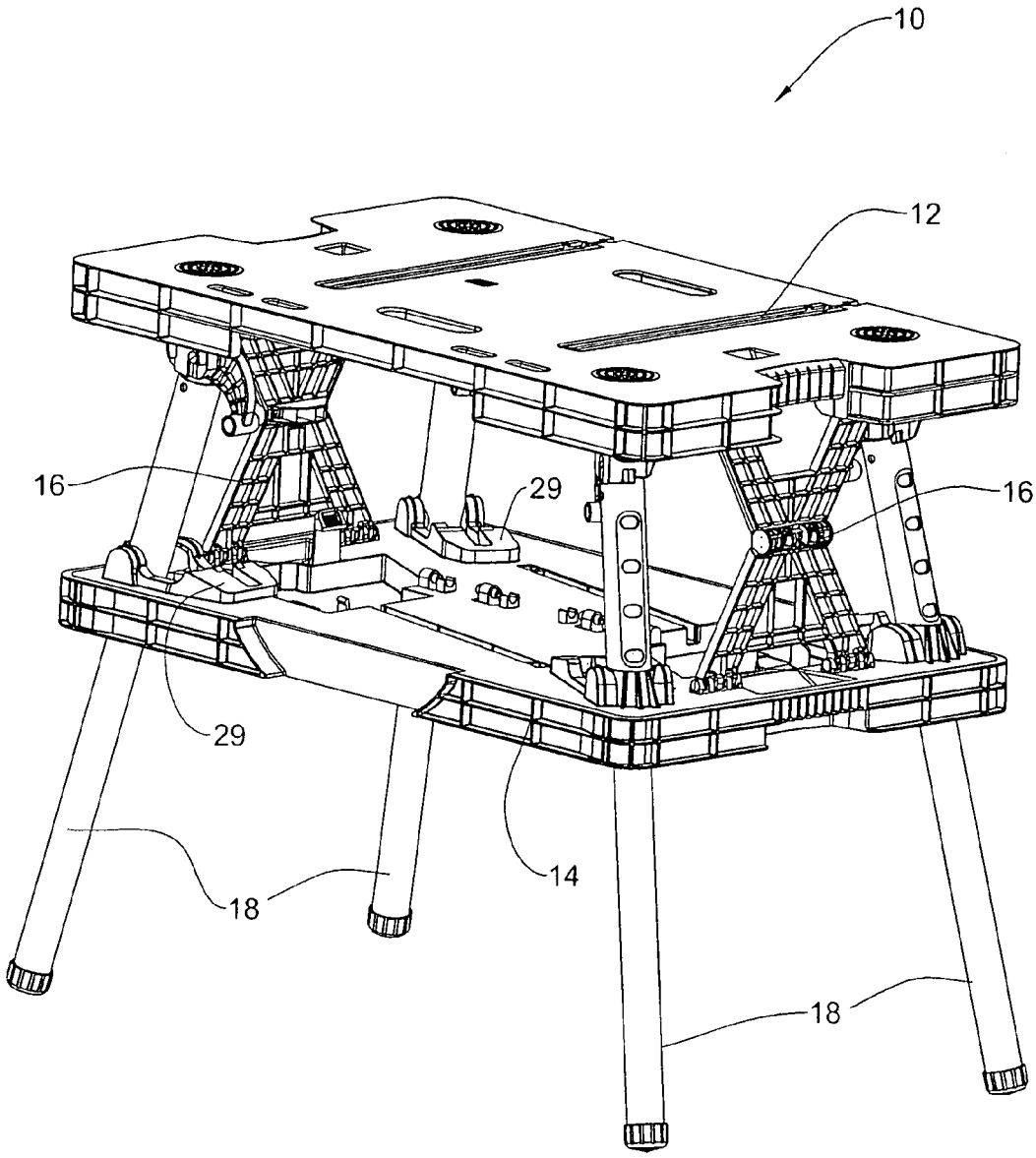
FIG. 1 is a perspective view of a table according to the present invention in an open position.
Figure 2A:
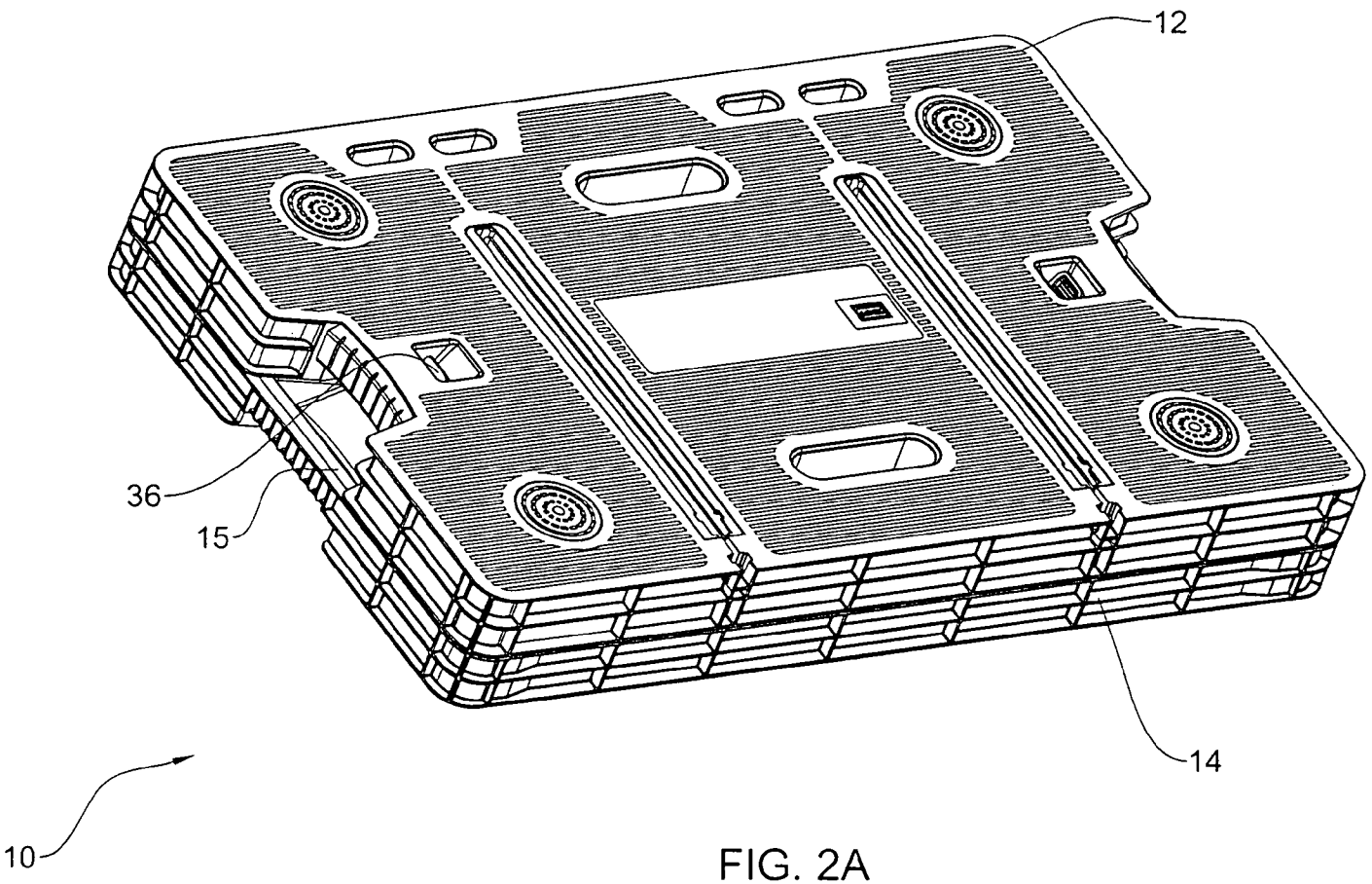
FIG. 2A is a top perspective view of the table illustrated in FIG. 1 in a closed position.
Figure 2B:
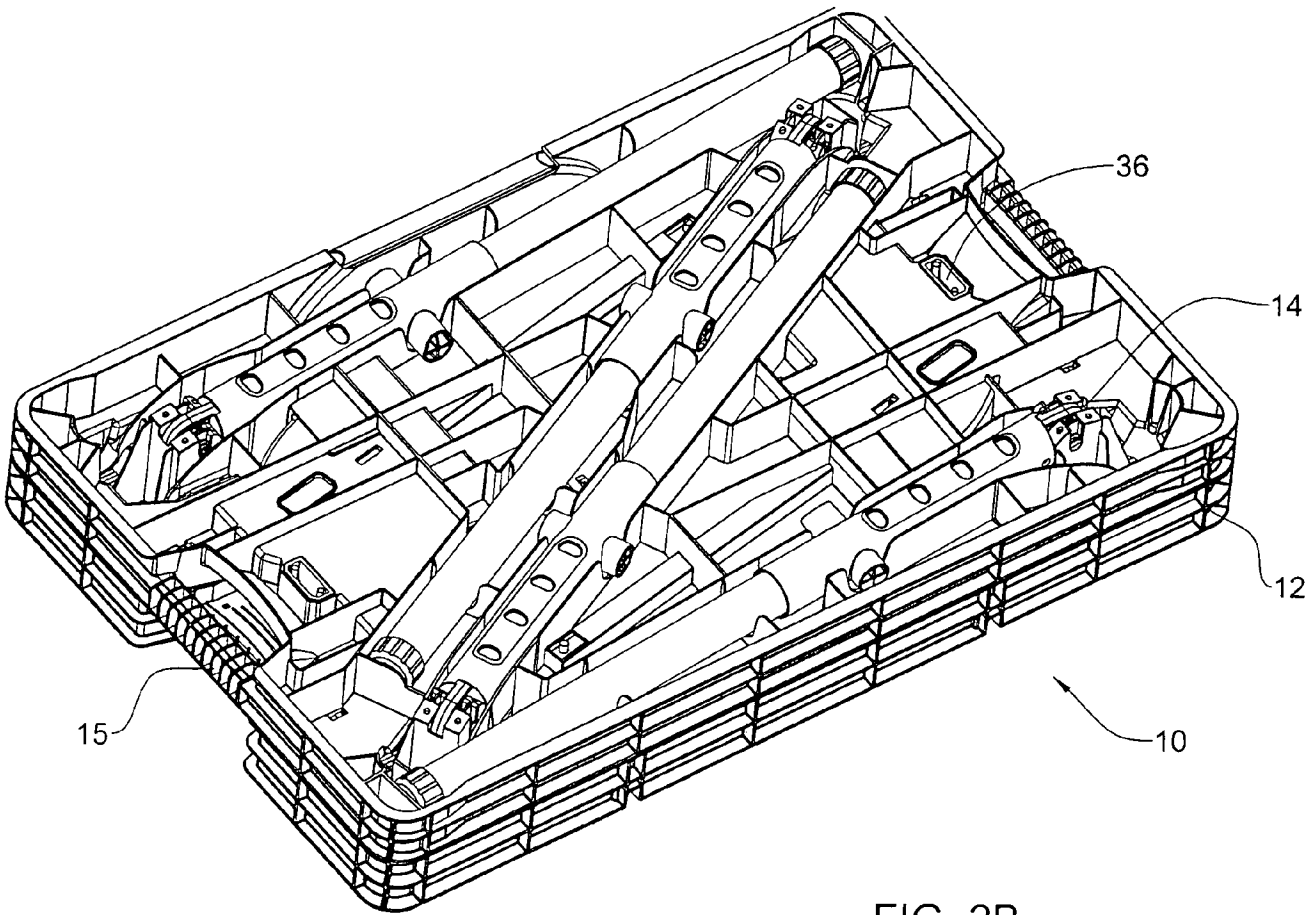
FIG. 2B is a bottom perspective view of the table illustrated in FIG. 1 in the closed position.

As seen in FIG. 1, there is provided a collapsible table 10. The table comprises an upper panel 12, a lower panel 14, two supports 16, and four legs 18. The table is collapsible between an open position, as illustrated in FIG. 1, and a closed position, as illustrates in FIGS. 2A and 2B.

Figure 3:
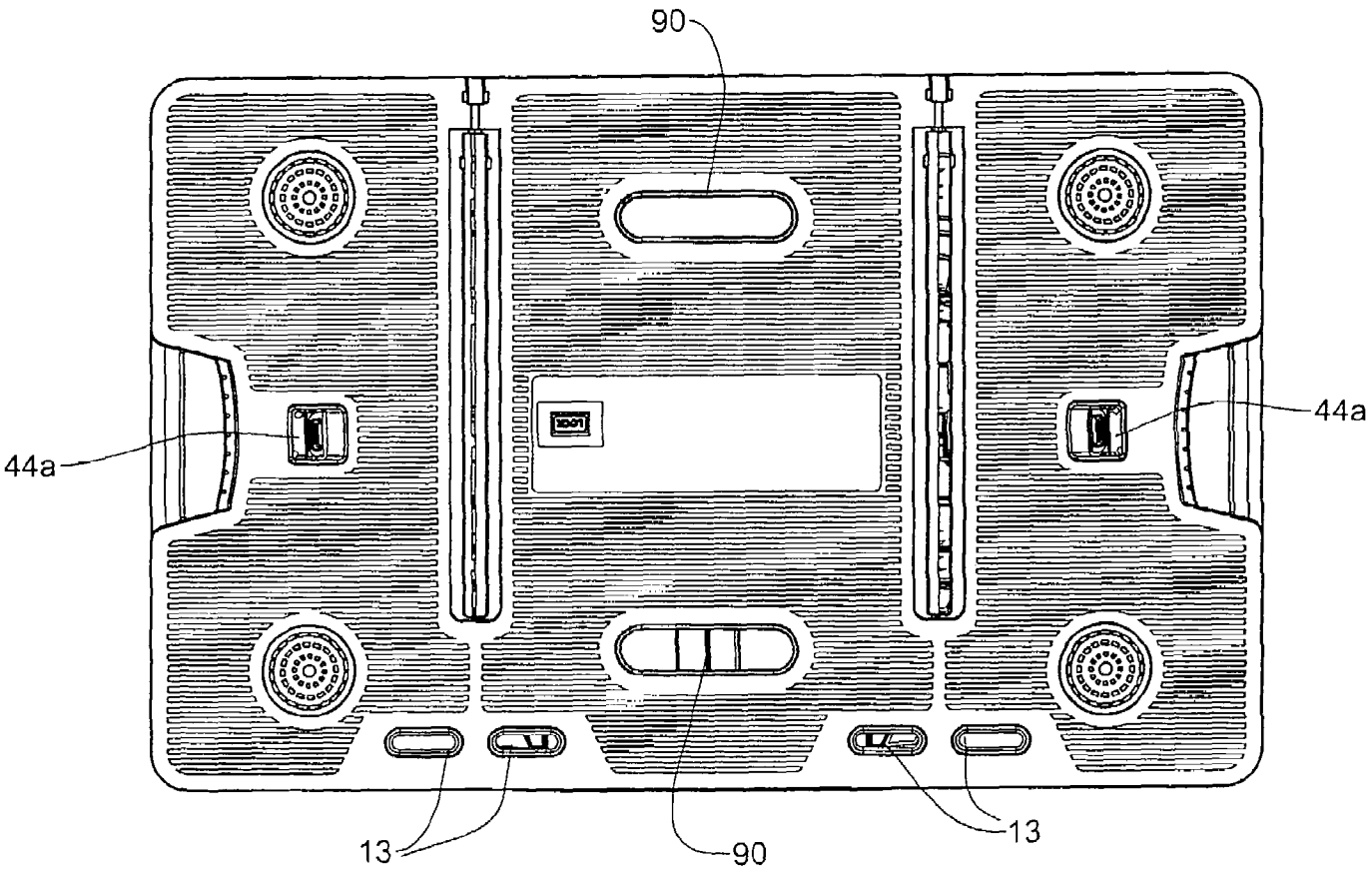
FIG. 3 is a plan view of an upper panel of the table illustrated in FIG. 1.
Figure 4A:
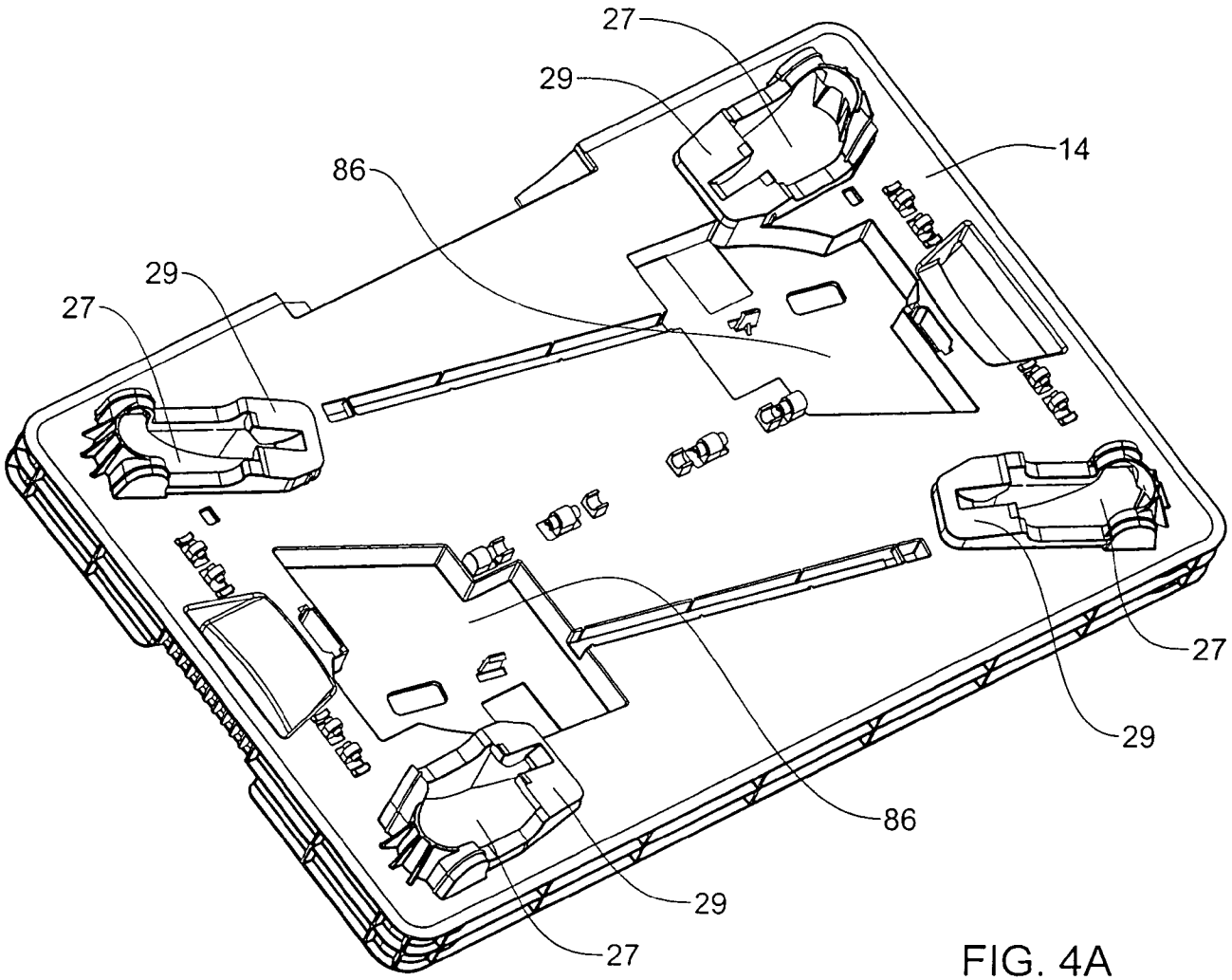
FIG. 4A is a top perspective view of a lower panel of the table illustrated in FIG. 1.
Figure 4B:
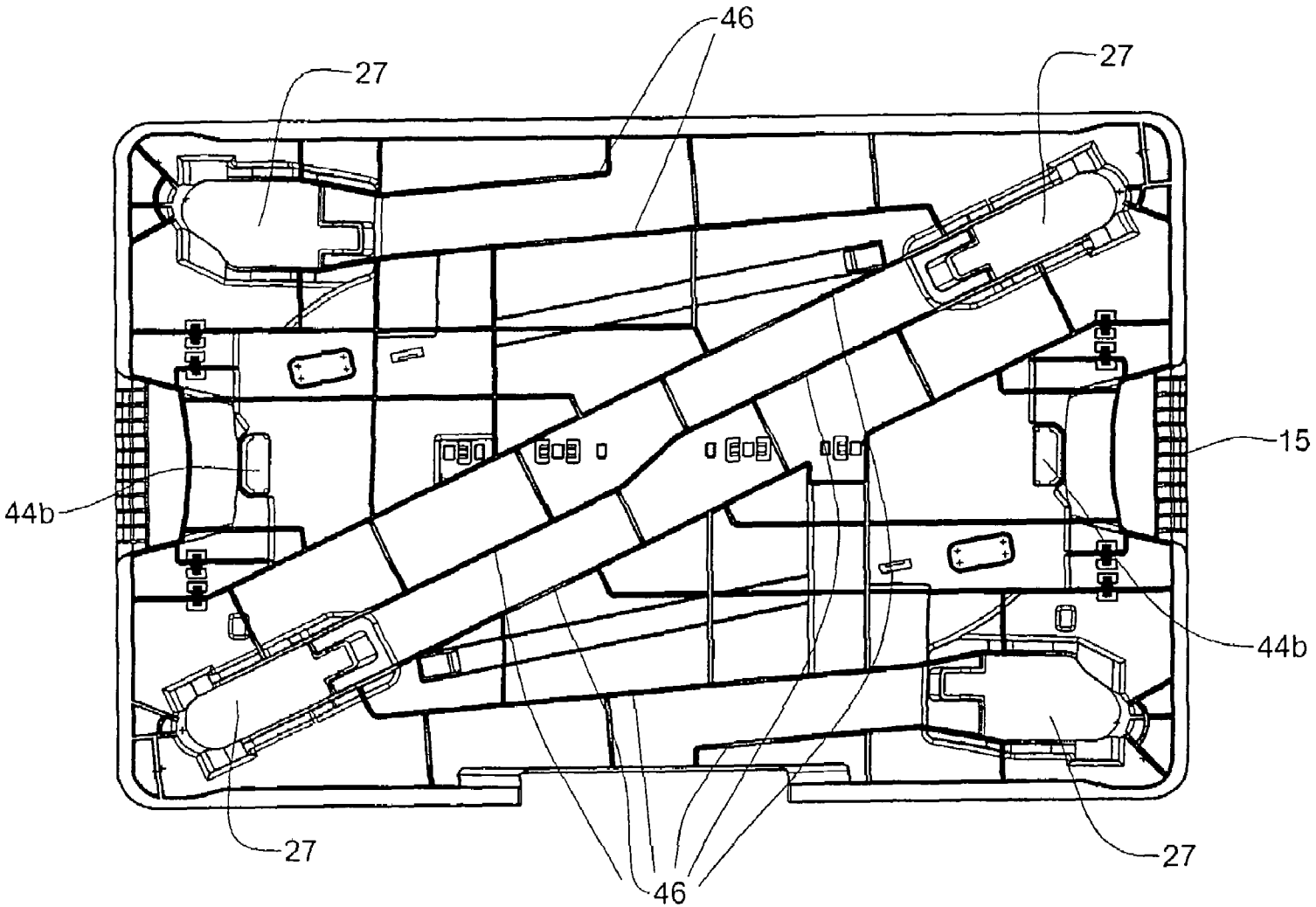
FIG. 4B is a bottom view of the lower panel illustrated in FIG. 4A.

The upper and lower panels 12, 14 are of corresponding shape, which allows for efficient storage of the table when in the collapsed position. As shown in FIG. 3, the upper panel may comprise a plurality of apertures 13 adapted to receive a variety of hand tools. As shown in FIG. 4A, the lower panel 14 comprises four elongate openings 27 and an inclined surface 29 adjacent each one on the upper edge thereof. As shown in FIG. 4B, the bottom surface of the lower panel comprises guides 46 adapted to receive the legs 18 when in the stowed position. Either the upper or lower panel 12, 14 may comprise a carrying handle 15 integrally formed therein and adapted to allow easy transport of the table 10 thereby. The other panel is shaped so as to permit gripping of the handle.

Figure 5A:
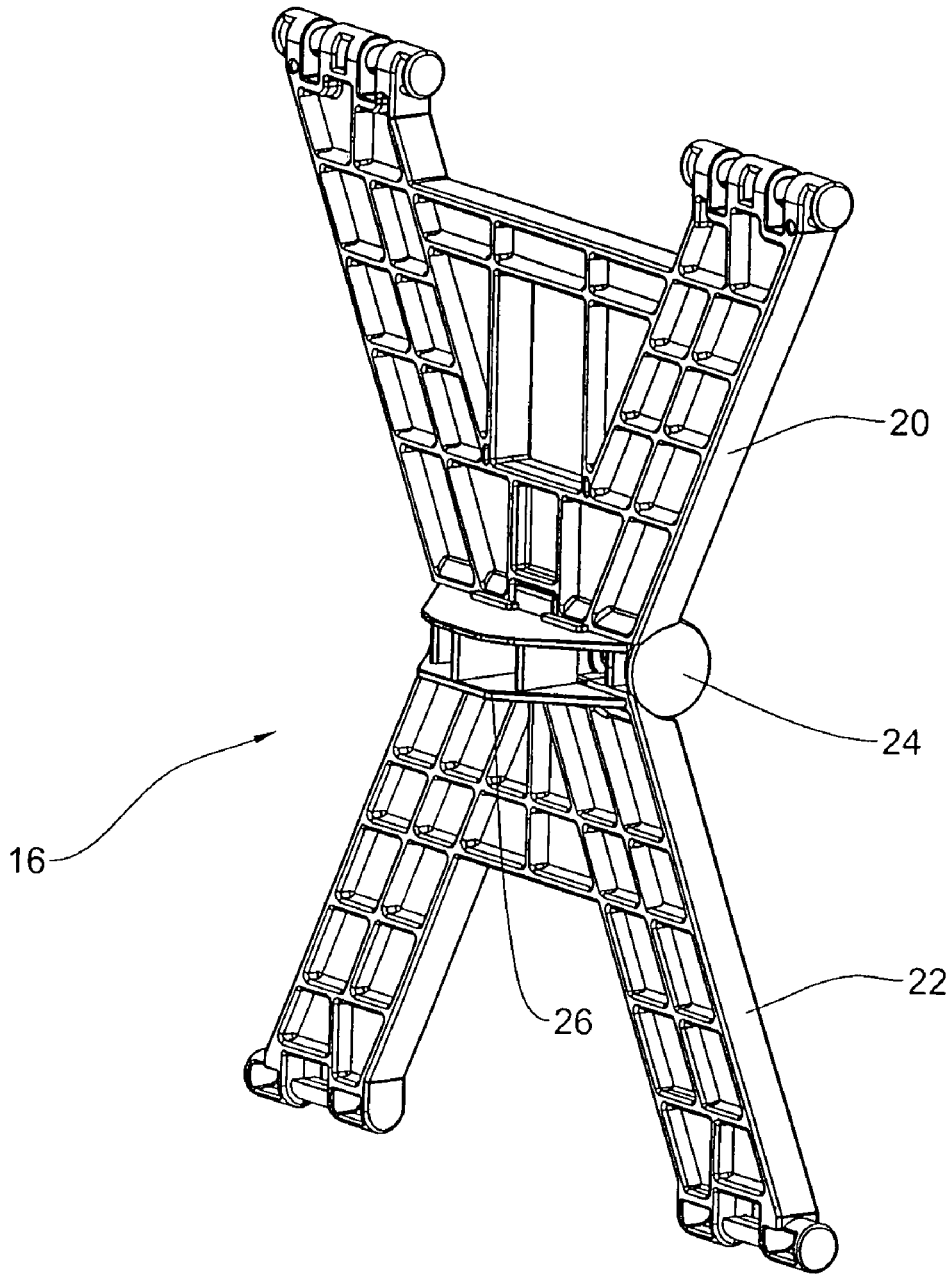
FIG. 5A is a perspective view of a support in an open position of the table illustrated in FIG. 1.
Figure 5B:
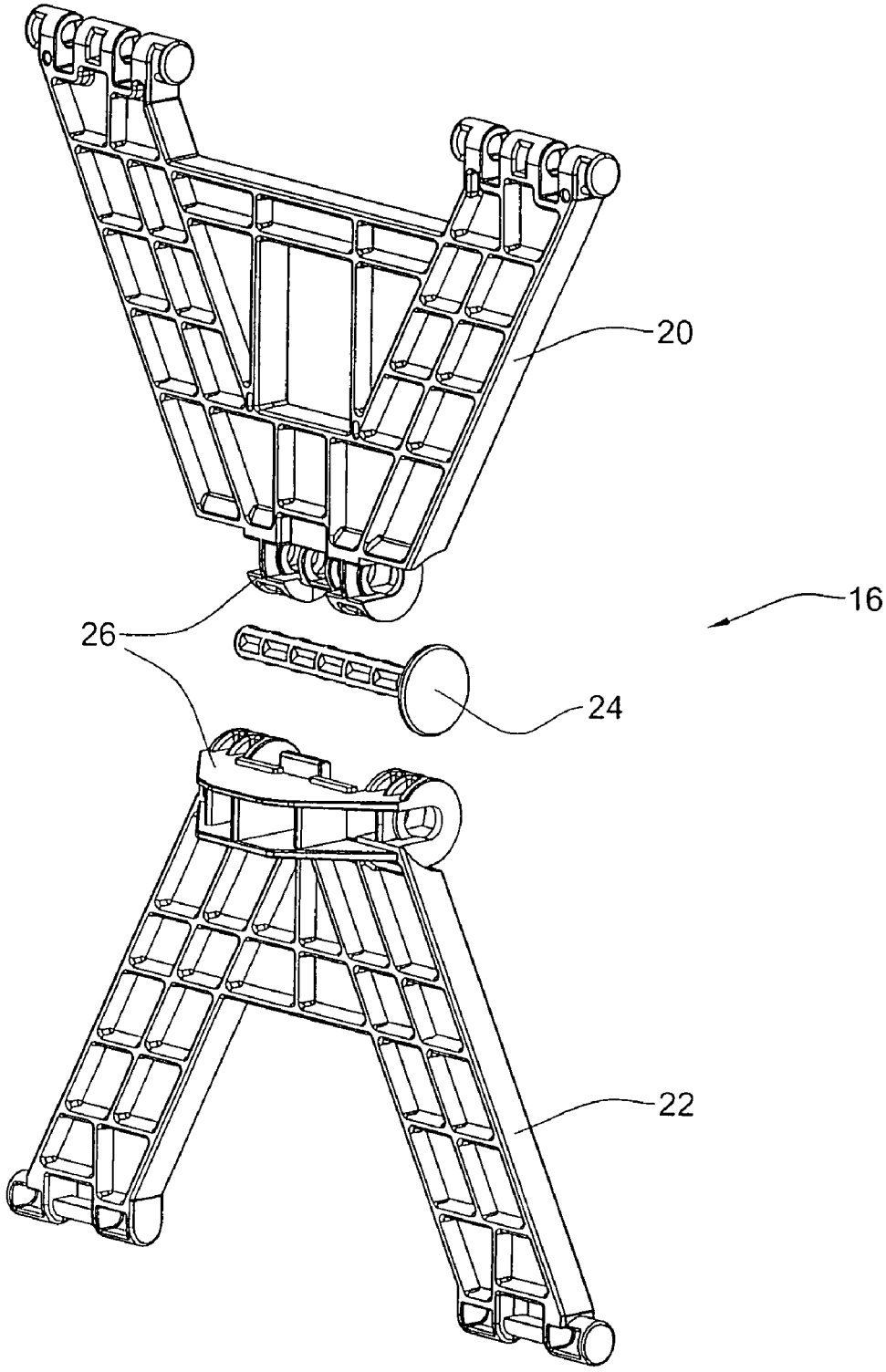
FIG. 5B is an exploded perspective view of the support illustrated in FIG. 5A.
Figure 5C:
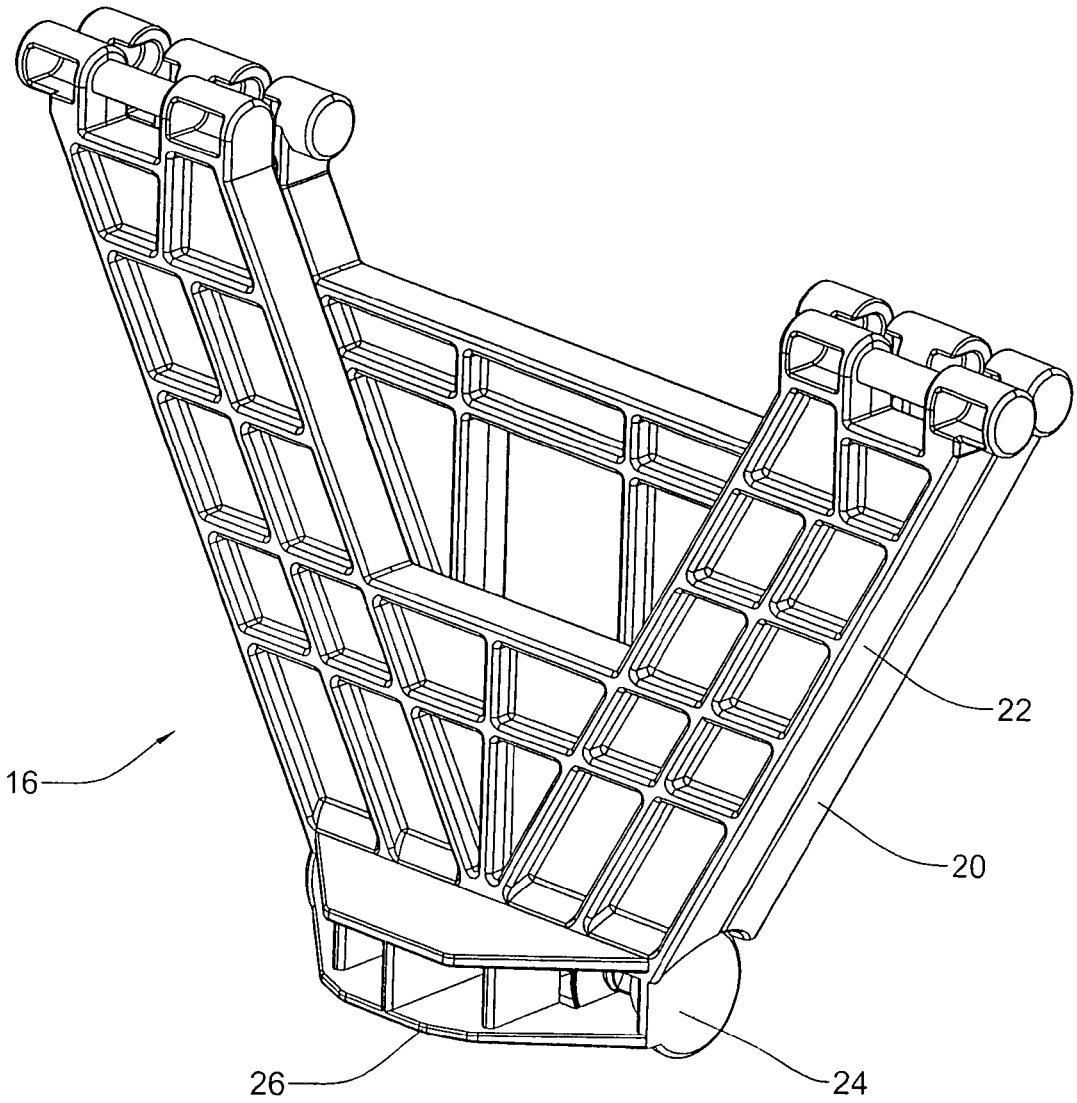
FIG. 5C is a perspective view of the support illustrated in FIG. 5A in a closed position.

Each support 16 is hingedly articulated at its top to the upper panel, and at its bottom to the lower panel. As seen in FIGS. 5A and 5B, it comprises an upper portion 20 and a lower portion 22. The two portions 20, 22 are hingedly articulated to each other by a rod 24. The support 16 is swingable about the rod 24 between an erect position and a collapsed position, as illustrated in FIG. 5C. The supports 16 are retained in the erect positions by a support latching arrangement 26 associates therewith.

Figure 6B:
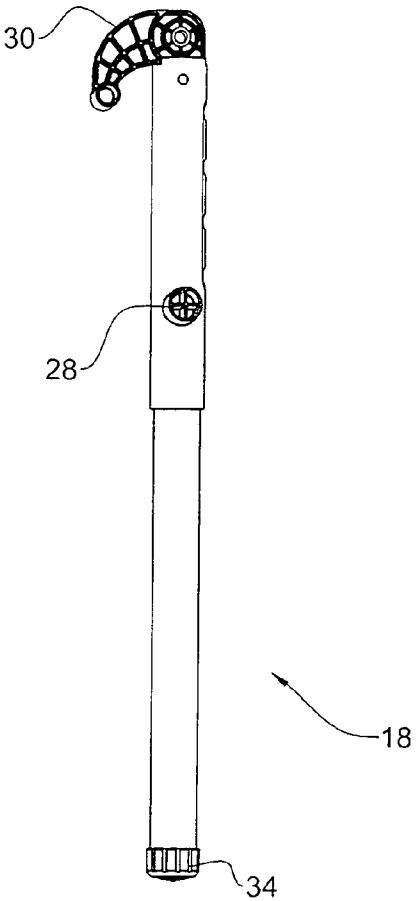
FIG. 6B is a side view of the leg shown in FIG. 6A.
Figure 6A:
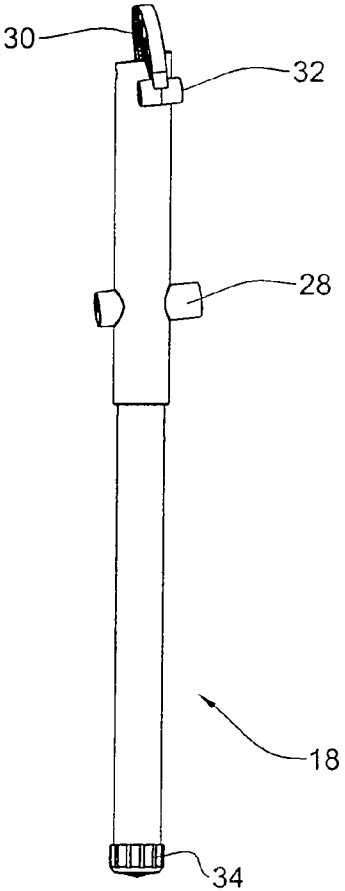
FIG. 6A is a front view of a leg of the table illustrated in FIG. 1.

The legs 18 are swingably articulated to the bottom surface of the upper panel 12. As seen in FIGS. 6A and 6B, the legs 18 each comprise lateral protrusions 28, which are positioned so as to provide support for the lower panel 14 when the table 10 is in the open position. At the top of each leg is a hooked member 30, which is useful when collapsing the table as described below. Each hooked member 30 has at its end a rounded knob 32. Each leg 18 may further comprise at its bottom a foot 34, adapted to protect the leg when in use and prevent the table from slipping when in the open position.

Figure 7:
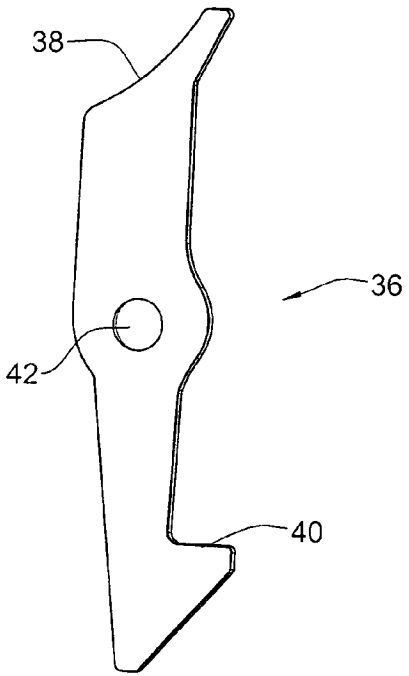
FIG. 7 is a side view of a table latching arrangement of the table illustrated in FIG. 1.

FIG. 7 illustrates a table latching arrangement 36. This arrangement is adapted to secure the table 10 in the closed position. It comprises a thumbpad 38 at a top end and a catch 40 at a bottom end. In the middle is a through-passing bore 42. The upper and lower panels 12, 14 each comprise apertures 44*a*, 44*b* adapted for use with the table latching arrangement. The table latching arrangement 36 is secured to the upper panel 12 such that the thumbpad 38 is accessible from the top of the panel and so that it is rotatable about an axis passing through the bore 42. The thumbpad does not extend above the top surface of the upper panel 12, and the bottom end of the arrangement 36 extends below the bottom surface thereof. When the table 10 is fully closed, the bottom end of the arrangement passes through aperture 44*b*, and the catch 40 receives the bottom surface of the lower panel 14, thereby securing the table in the closed position.

In operation, the table 10 is initially in the closed position. In order to open the table, the table 10 is held parallel to the ground, with the upper panel 12 above the lower panel 14. The thumbpads 38 are depressed, causing the catches 40 to disengage from the lower panel 14, which undergoes displacement away from the upper panel 12 and toward the ground. As a result, the supports 16 shift to their erect positions and latch, and the legs 18 swing into their open positions. The displacement of the lower panel 14 is limited by two factors. The first is the length of the supports 16. The second is the presence of the lateral protrusions 28 on the legs 18. These two factors also provide support for the lower panel 14.

To collapse to table 10, the support latching arrangements 26 are disengaged, allowing the supports 16 to be shifted to their collapsed positions. The lower panel 14 is displaced toward the upper panel. Before the panels fully contact one another, the inclined surfaces 29 begin to push on the hooked members 30 of the legs 18. Further displacement of the lower panel 14 pushes the rounded knob 32 upward, which swings the leg into the stowed position. The inclined surfaces 29 also serve to retain the legs 18 in the stowed position when the table 10 is fully closed.

Figure 8C:
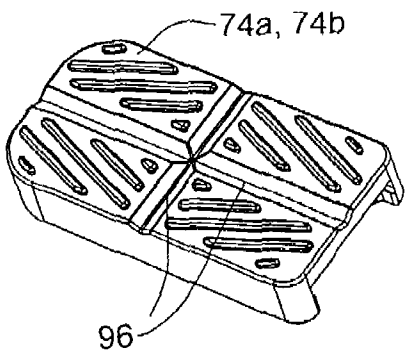
FIG. 8C is a perspective view of a jaw foot of the vise illustrated in FIGS. 8A and 8B.
Figure 8A:
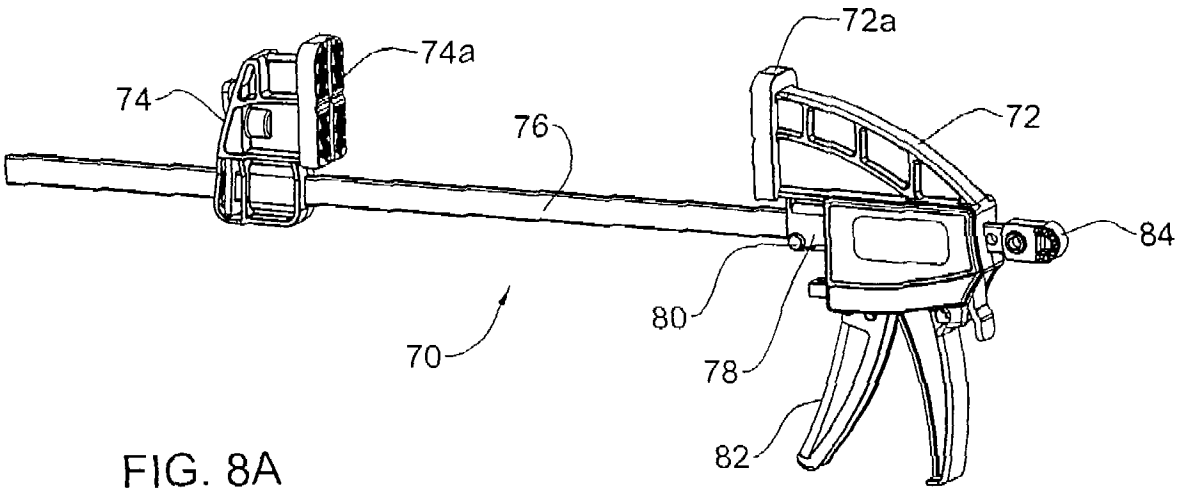
FIGS. 8A and 8B are perspective views of a vise for use with the table illustrated in FIG. 1.
Figure 8B:
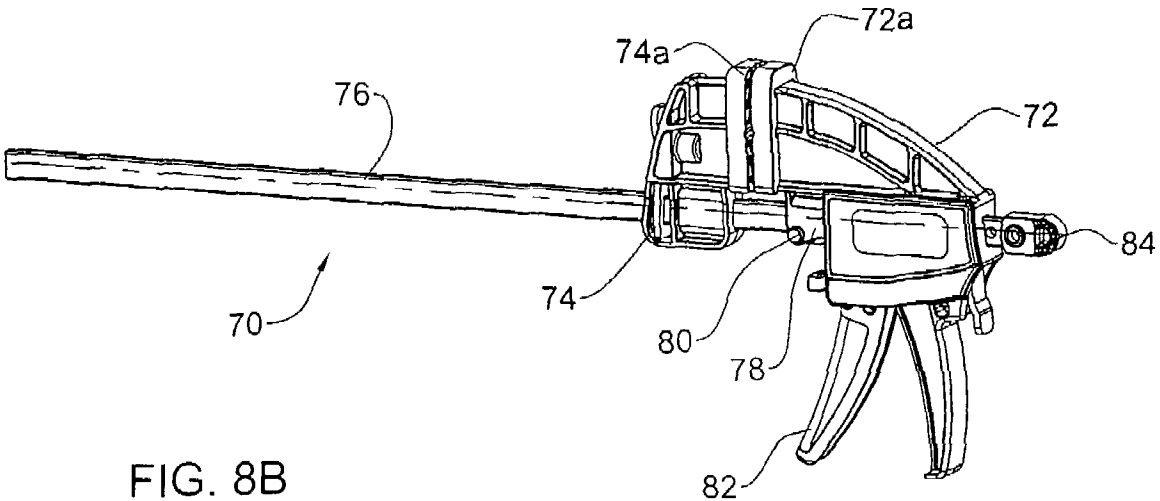

According to one modification, the table 10 comprises vise 70, illustrated in FIGS. 8A and 8B. The vise 70 comprises a fixed jaw section 72, a movable jaw section 74, and a rail 76, which exits the fixed jaw section 72 via a sleeve 78. Each jaw section 72, 74 comprises a jaw foot 72*a*, 74*a*. The sleeve comprises two lateral extensions 80. The movable jaw section 74 may be secured to any location along the length of the rail 76. Tightening of the vise is accomplished by engaging a squeeze handle 82. This results in sliding displacement of the rails toward the fixed jaw section. The rail 76 may be slid away from the fixed jaw section 72, thereby loosening the vise, by engaging a release lever 84.

The table is specially adapted for use with the vise 70. The lower panel 14 comprises molded grips 86, each adapted to snugly and fully receive a vise 70. In order not to interfere with closing of the table 10, the vise 70 is preferably no thicker that the lower panel 14.

Figure 9A:
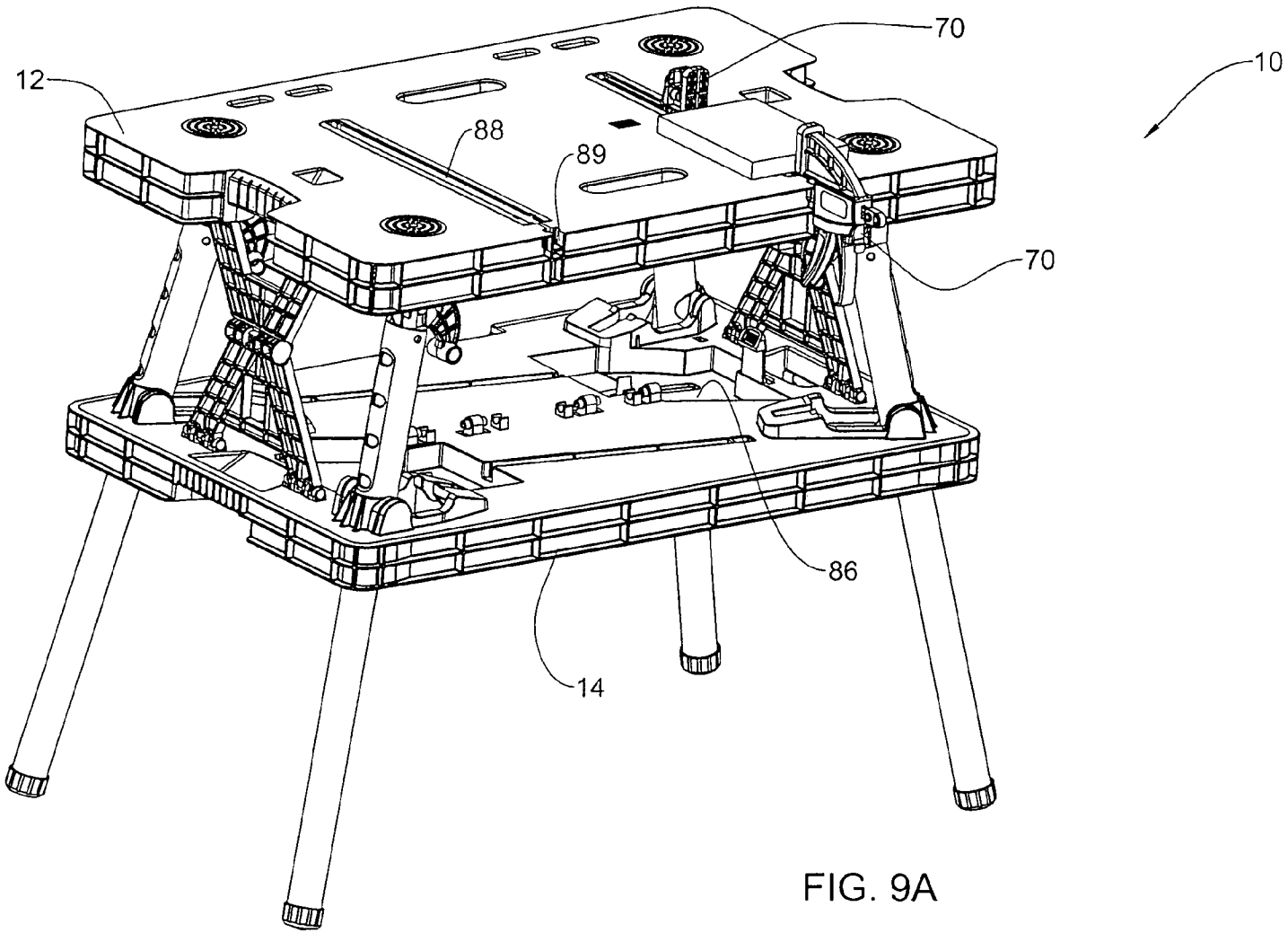
FIGS. 9A through 9D are perspective views of the table illustrated in FIG. 1 showing different uses of the vise therewith.

The upper panel 12 comprises at least one groove 88 adapted to receive the rail 76 of the vise 70. The table, at the ends of the grooves 88, comprises T-shaped niches 89 coaxial therewith and adapted to receive the sleeve 78 at a distal end. The vise may be thus securely held to the table 10 as illustrated in FIG. 9A.

Figure 9B:
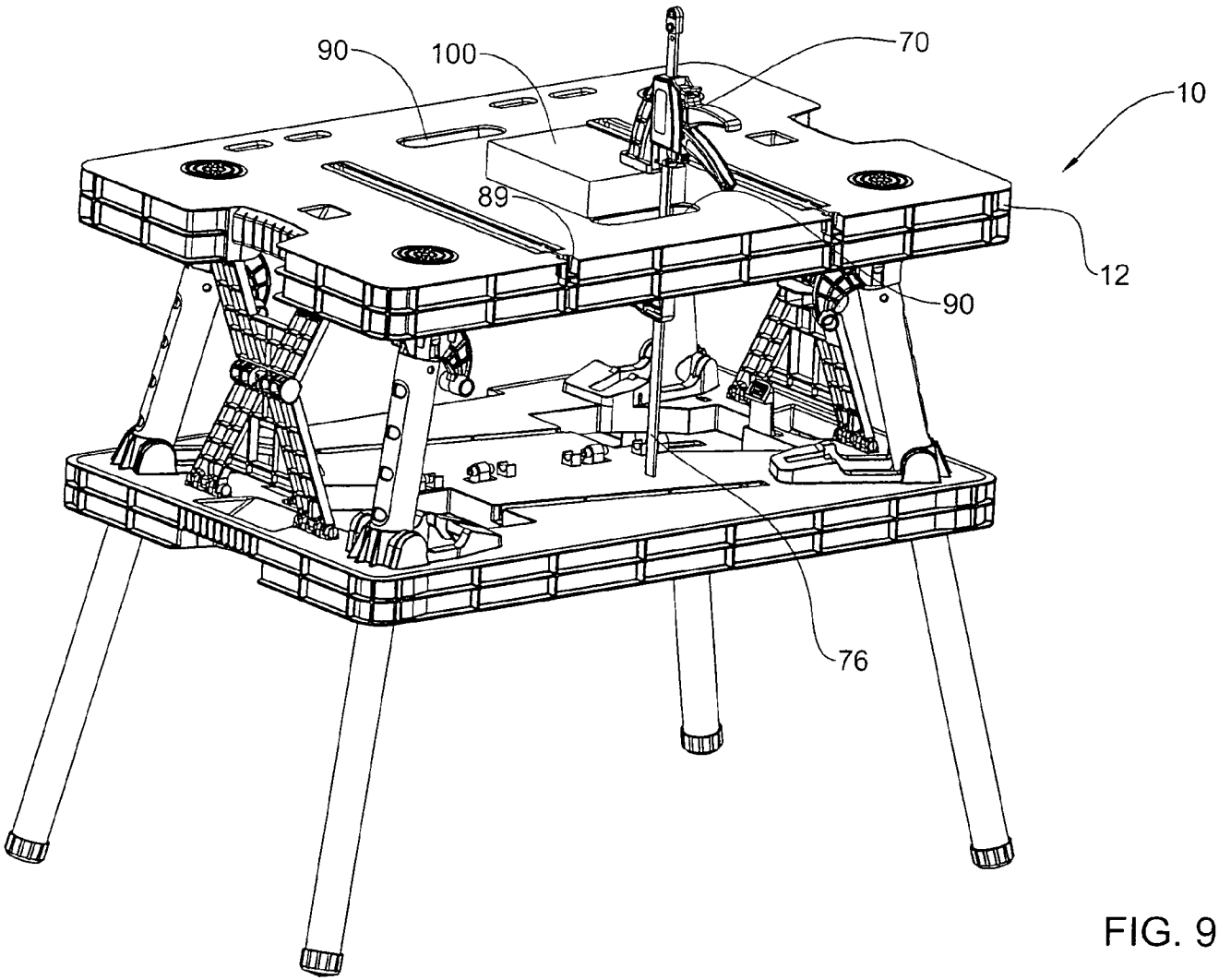
Figure 9C:
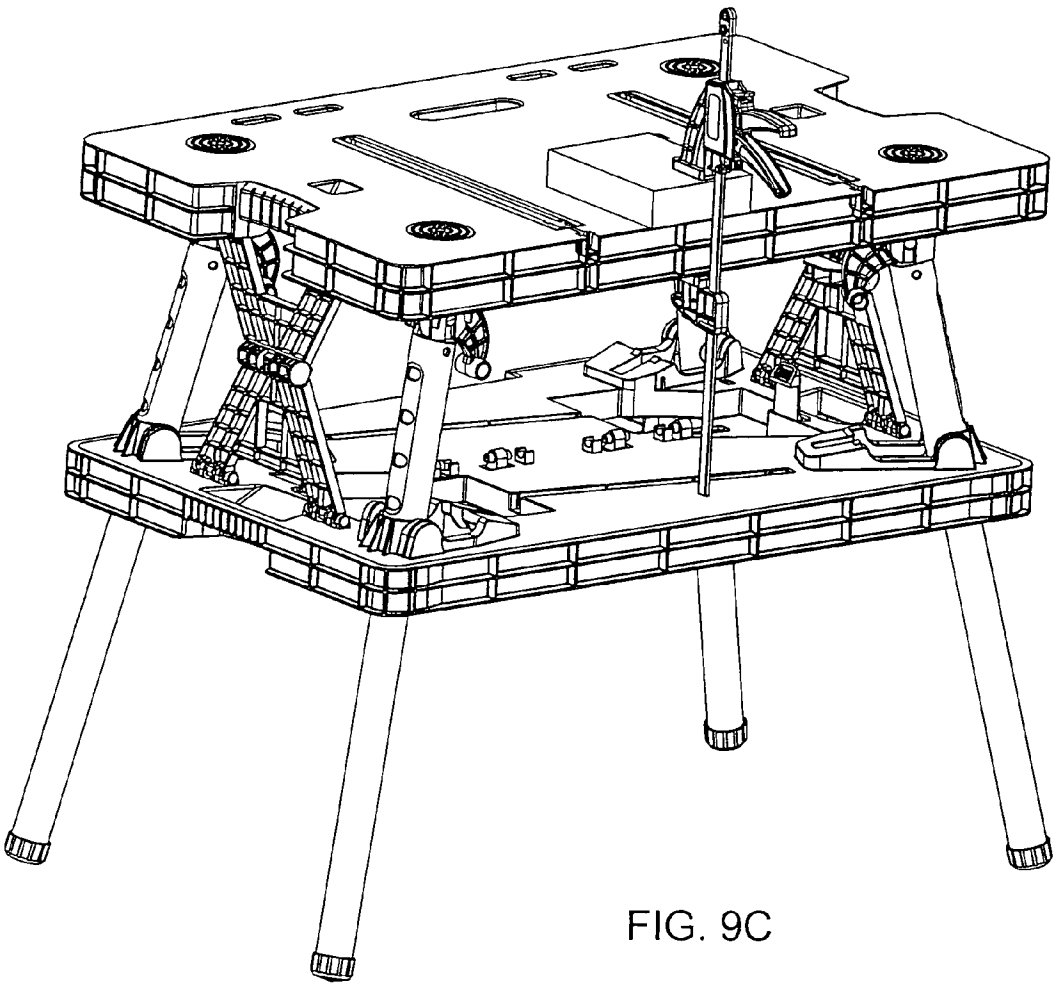
Figure 9D:
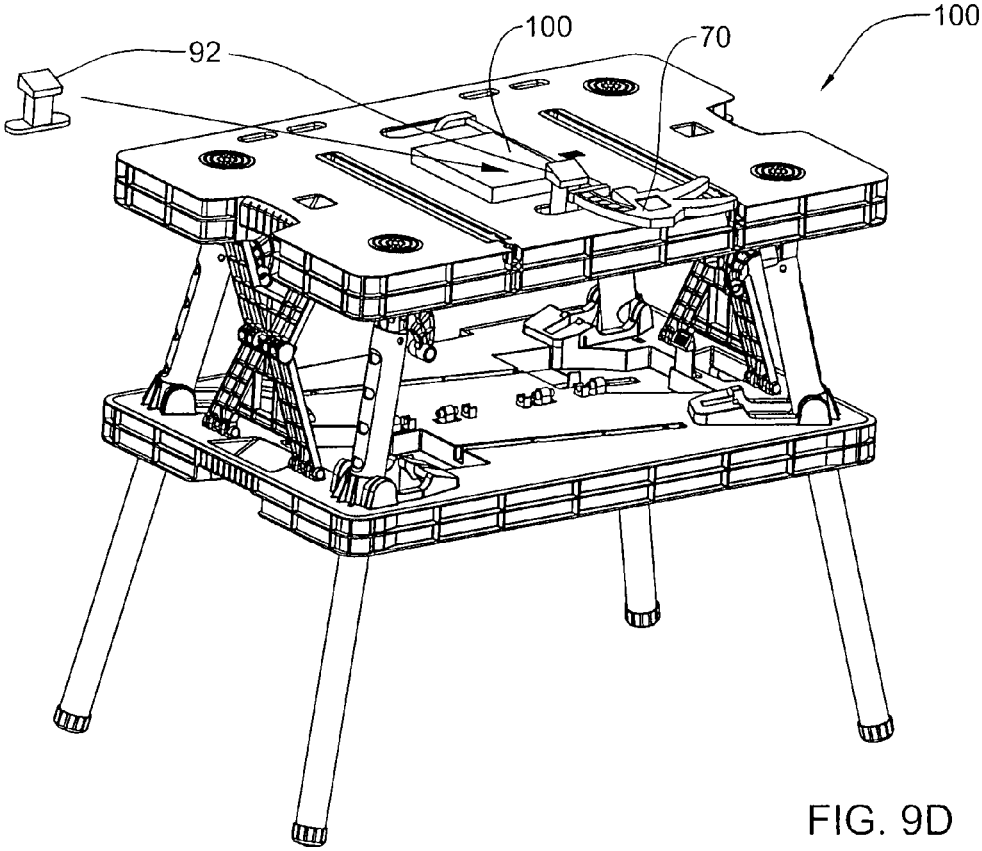
Figure 9E:
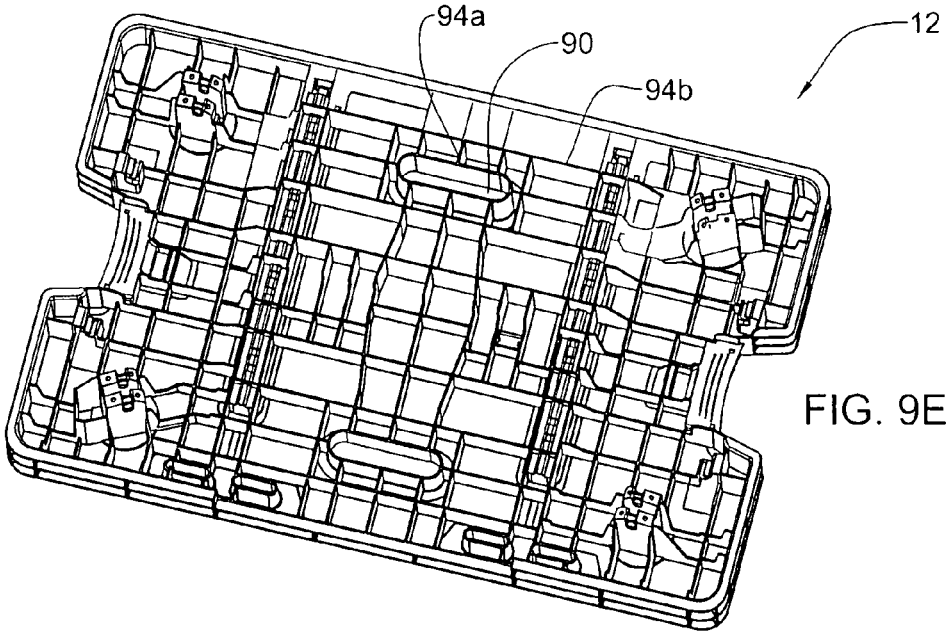
FIG. 9E is a bottom perspective view of the upper panel.

As seen in FIG. 9B, the upper panel 12 further comprises several through-passing apertures 90. The apertures 90 are adapted to be used in conjunction with the vise 70 to clamp an article 100 to the table 10 in an area of the top edge which is not immediately adjacent the side edge thereof. In use, the vise 70 is disposed on the table so that the rail 76 passes downwardly through the aperture 90. The movable jaw section 74 (not seen in FIG. 9B) is attached to the rail 76 below the upper panel 12. In this way, the vise 70 may be used to clamp the article 100 to areas adjacent the apertures 90. In order to facilitate the clamping in this fashion, the area of the upper panel 12 along the perimeters of the apertures 90 are reinforced by laterally extending ribs 94*a*, as illustrated in FIG. 9E. In addition margins areas along the perimeter of the upper panel 12 are reinforced with laterally extending ribs 94*b* to permit clamping the vise 70 thereto, as seen in FIG. 9C. As seen in FIG. 8C, the jaw feet 72*a*, 74*a* may comprises grooves 96 adapted to receive the ribs 94*a*, 94*b* when the vise 70 is clamped to the table. As seen in FIG. 9D, the apertures may be used in conjunction with a chuck 92 for clamp the article to the table.

Those skilled in the art to which this invention pertains will readily appreciate that numerous changes, variations and modifications can be made without departing from the scope of the invention mutatis mutandis. For example, the shape of the panels may vary, as may the number of legs. It should also be noted that while the embodiment described herein is particularly useful as a worktable, the scope of the present invention is not limited to such use. The collapsible table described herein may be adapted for other uses, such as for food service, laboratory use, infant changing table, etc., without departing from the spirit and scope of the invention.

The invention claimed is:

1. A folding table comprising an upper panel, a lower panel, and a plurality of legs swingably articulated to the upper panel at a bottom surface thereof, and the legs are slidingly received within apertures in the lower panel, the table being collapsible between an open position, in which the panels are separated parallely, and a closed position, in which the panels are parallely adjacent, wherein each leg is readily shiftable between a substantially upright position when the table is in the open position and a stowed position when the table is in the closed position, said table further comprising arrangements, each having at least a first element mounted on the top of each leg and at least a second element formed in a top surface of the lower panel, said first and second elements being disposed so that sliding of the lower panel towards the upper panel until the elements bear upon each other during collapsing of the table from the open position to the closed position so as to shift the legs to their stowed positions.

2. A table according to claim 1, further comprising at least two supports attaching said panels, each support being readily shiftable between a collapsed position when the table is in the closed position and an erect position when the table is in the open position.

3. A table according to claim 2, wherein each support comprises an upper portion and a lower portion hingedly articulated to one another.

4. A table according to claim 2, wherein when the table is converted into the open position, the bottom panel is displaced by the force of gravity, thereby entailing shifting of the legs to their upright position and the supports to their erect positions.

5. A table according to claim 2, wherein the table is retained in the open position by a second latching arrangement associated with the supports.

6. A table according to claim 1, wherein the table is retained in the closed position by a first latching arrangement associated with the panels.

7. A table according to claim 1, wherein the lower panel comprises elongate openings, each sized and located so as to permit swinging therein of a leg.

8. A table according to claim 1, wherein when the table is in the closed position, the legs are received within the bottom panel.

9. A table according to claim 1, wherein each of said arrangements is a cam and follower arrangement, with the cam constituting one of said first and second elements, and the follower constituting the other of said elements.

10. A table according to claim 9, wherein each cam is in the form of an inclined surface associated with the lower panel and each follower is in the form of a hooked member with a rounded end protruding from each leg.

11. A table according to claim 1, wherein the panels, when the table is in the closed position, are in full contact with one another.

12. A table according to claim 1, further comprising a carrying handle.

13. A table according to claim 12, wherein the carrying handle is integrally formed within at least one of the panels.

14. A table according to claim 1, wherein the upper panel comprises contrivances for retaining tools therein.

15. A table according to claim 1, further adapted to store, in at least one of the panels, a vise.

16. A table according to claim 15, wherein, when the vise is stored, it is fully received within with a surface of the panel.

17. A table according to claim 15, wherein the vise comprising a fixed jaw section and a movable jaw section connected to the fixed section by a rail and adjustable along the length of the rail.

18. A table according to claim 17, further comprising at least one groove formed in a top surface of the upper panel adapted for use with the vice.

19. A table according to claim 18, the fixed jaw section of the vise comprising a sleeve extending toward the movable jaw section and adapted for exiting therethrough of the rail, the sleeve comprising at a distal end two lateral extensions, wherein the upper panel comprises at least one T-shaped niche coaxial with the groove, the niche adapted to receive the distal end of the sleeve, thereby holding the vise.

20. A table according to claim 19, the upper panel comprising at least one reinforced through-passing aperture.

21. A table according to claim 20, wherein the reinforcement is accomplished by lateral ribs.

22. A table according to claim 20, wherein the through-passing aperture is adapted to receive the vise by passage therethrough of the rail, allowing the fixed jaw section to abut a top surface of the upper panel and the movable jaw section to abut the bottom surface of the upper panel.

23. A table according to claim 20, further comprising a chuck receivable within the aperture and adapted, when thus received, to cooperate for clamping with the vise in a lying position.

24. A table according to claim 1, wherein the upper panel is reinforced at side margin areas.

* * * * *